United States Patent [19]

Panu

[11] 4,060,759

[45] Nov. 29, 1977

[54] TUBE-INSULATED SHELL-CORE CURRENT TRANSFORMER

[75] Inventor: Kalevi Panu, Vaasa, Finland

[73] Assignee: Oy Stromberg AB, Vaasa, Finland

[21] Appl. No.: 620,114

[22] Filed: Oct. 6, 1975

[30] Foreign Application Priority Data

Oct. 18, 1974 Finland ..... 743148

[51] Int. Cl.[2] ..... H01F 40/06

[52] U.S. Cl. ..... 323/60; 336/83; 336/178; 336/182; 336/212

[58] Field of Search ..... 336/83, 60, 173, 174, 336/175, 160, 165, 178, 212, 180, 182; 323/60, 6

[56] References Cited

U.S. PATENT DOCUMENTS 3,792,396 2/1974 Panu ..... 336/178

*Primary Examiner*—Thomas J. Kozma

*Attorney, Agent, or Firm*—Young & Thompson

[57] ABSTRACT

A shell-core current transformer comprising a tubular main insulator, a measuring core arranged at least substantially coaxially with the main insulator and comprising a primary winding and a secondary winding, and a protecting core, likewise arranged at least substantially coaxially with the main insulator and comprising a primary winding and a secondary winding. The measuring core and the protecting core have a common primary winding, arranged outside the main insulator, and a common outer core part functioning as magnetic return circuit. The inner part of the measuring core, with the exception of the inner yoke portions, and the secondary winding of the measuring core are within the main insulator placed inside the inner part of the protecting core and inside the secondary winding of the protecting core, and the measuring core and the protecting core have common inner yoke portions.

7 Claims, 3 Drawing Figures

TUBE-INSULATED SHELL-CORE CURRENT TRANSFORMER

The subject of the present invention is a shell-core current transformer that comprises a tubular main insulator, a measuring core arranged at least substantially coaxially with the main insulator and comprising a primary winding and a secondary winding, a protecting core, likewise arranged at least substantially coaxially with the main insulator and comprising a primary winding and a secondary winding.

A similar shell-core current transformer is previously known, for example, from U.S. Pat. No. 3,795,881. In such a transformer both the measuring core and the protecting core are placed coaxially with the insulator tube and axially at a certain distance from each other. In such a construction the separate measuring core, however, requires a relatively large space and quantity of rawmaterial even if the meter safety factor required (e.g. $n < 5$) were much lower than the marginal accuracy factor of the protecting core (e.g. $n > 75$). In the manufacture of a separate measuring core, work is additionally required for cutting the core sheets and for piling them as well as for bending the primary winding. In the primary and secondary windings of a separate measuring core, rather high losses of copper arise, which causes additional heating.

The purpose of the present invention is to eliminate the above drawbacks and to provide a shell-core current transformer of a novel type.

The shell-core current transformer is mainly characterized in that the measuring core and the protecting core have a common primary winding, arranged outside the main insulator, and a common outer core part functioning as magnetic return circuit, the inner part of the measuring core, with the exception of the inner yoke portions, and the secondary winding of the measuring core are within the main insulator placed inside the inner part of the protecting core and inside the secondary winding of the protecting core, and the measuring core and the protecting core have common inner yoke portions.

By means of the present invention, it has been possible to eliminate the copper losses of the current transformer almost completely. At the same time it has been possible to reduce the quantity of copper required by the measuring winding to a considerable extent.

Below, the invention will be examined in more detail with the aid of the embodiment in accordance with the attached drawings.

Figure 1:
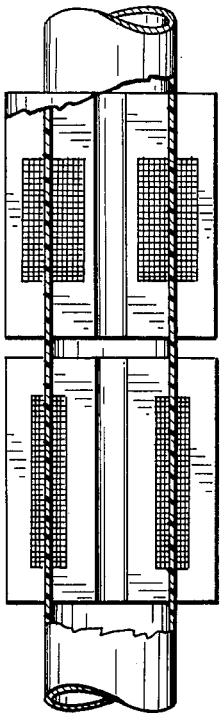
PRIOR ART FIG. 1

FIG. 1 shows an axial section of a prior art tube-insulated shell-core current transformer.

Figure 2:
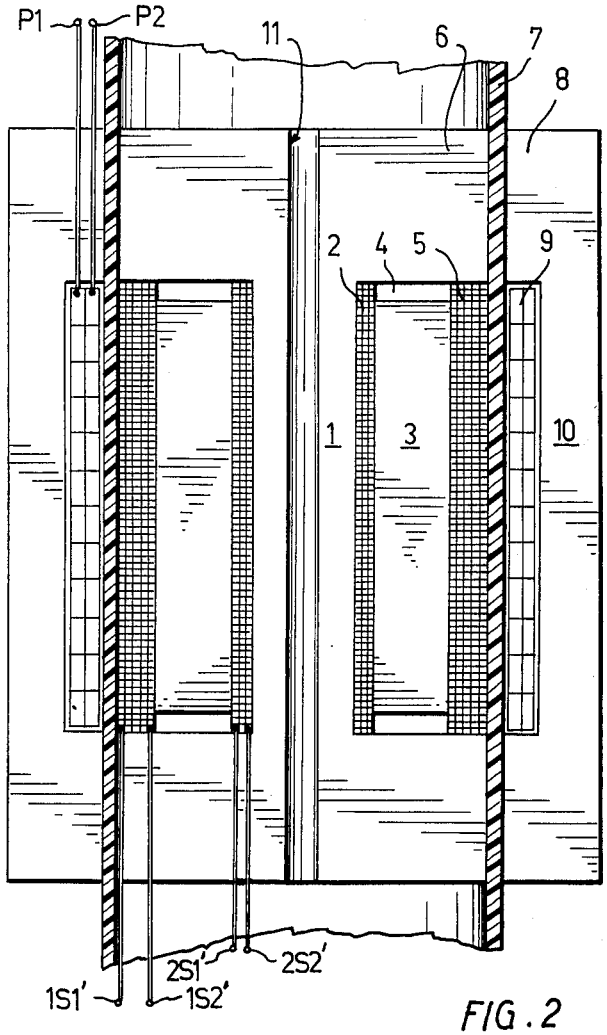

FIG. 2 likewise shows an axial section of one embodiment of a current transformer in accordance with the present invention.

Figure 3:
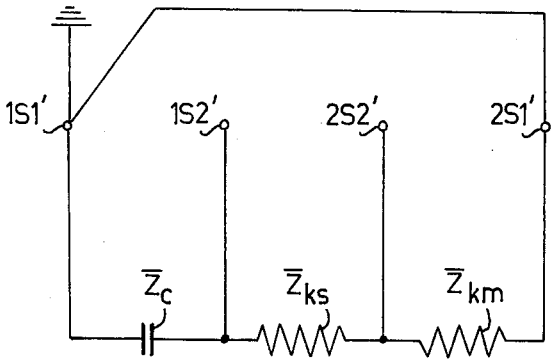

FIG. 3 shows the principal wiring diagram of the current transformer of FIG. 2.

As seen FIG. 2, the current transformer in accordance with the invention includes a main insulator 7 having the shape of a hollow cylindrical tube and being coaxially surrounded by a primary winding 9. This primary winding 9 is, on the other hand, on the outside surrounded by an outer core part 10 which functions as magnetic return circuit and which, together with its outer yokes 8, is mainly shaped as a hollow cylindrical tube into which an inside annular cavity has been made to incorporate said primary winding 9.

On the other hand, the inner part 1 of the measuring core is placed coaxially inside the main insulator tube 7. Said inner part 1, together with its inner yokes 6, forms a structure having in principle the shape of a reel through which an axial channel 11 passes. This cylindrical channel 11 functions, among other things, as a cooling channel. The inner yoke parts 6 of the construction in accordance with FIG. 2 are arranged to match the inner surface of the main insulator tube 7. In the annular cavity of this construction, next to the axis, is placed the measuring winding 2 which functions as the secondary winding and which is, on the other hand, surrounded by a protecting core 3. The protecting core 3 is, on the other hand, surrounded by a protecting winding 5 which, likewise, functions as a secondary winding and whose outer mantle surface is arranged to match the inner surface of said main insulator tube 7.

In the embodiment presented, the axial dimensions of the primary winding 9, of the protecting winding 5, and of the measuring winding 2 are equal, and these windings are placed axially opposite each other. Similarly, the outer core part 10 functioning as magnetic return circuit, with its outer yokes 8, and part 1 of the measuring core, with its inner yokes 6, respectively, have equal axial dimensions and are placed axially opposite each other. The axial dimension of the protecting core 3, having the shape of a hollow cylindrical tube and being placed between the measuring winding 2 and the protecting winding 5, is slightly inferior to the axial dimension of the measuring winding 2 and that of the protecting winding 5 so that an air gap 4 is formed at each end between the ends of the protecting core 3 and the inner yokes 6.

Thus, the inner part 1 of the measuring core with its secondary widing 2 is placed coaxially inside the protecting core 3, and the secondary windings 5 and 2 of the protecting core 3, and of the measuring core 1, 10, respectively, are connected in series. The terminals of the primary winding 9 are denoted with P1 and P2, the terminals of the protecting winding 5, functioning as a secondary winding, with 1S1′ and 1S2′, and the terminals of the measuring winding 2, functioning as a secondary winding, with 2S1′ and 2S2′. The measuring load is connected to the terminals 2S1′, 2S2′ of the secondary winding 2 of the measuring core and the protecting load to the extreme terminals 1S2′ and 2S1′ of the series connection between the secondary windings 2 and 5 (FIG. 2 and 3). The measuring load can also be connected by means of a small separation transformer, whereby the primary terminals of the separation transformer are connected between 2S1′ and 2S2′.

When the apparatus operates with rated current and with nominal loads, a rated secondary current flows in the secondary winding 5 of the protecting core 3 the accuracy of said current corresponding to the normal accuracy of a protecting core. In the measuring winding 2 a small balancing current flows which, when added to the current of the protecting secondary winding 5, gives a sufficiently accurate measuring current. Thus, the generation of the measuring current requires practically no copper losses at all. The quantity of copper required by the measuring winding 2 is also very small owing to the small cross-section area and small circumferential length. With short-circuit current, the measuring winding 2 is saturated and the current of the protecting winding 5 passes through the measuring winding 2. This is why the measuring winding 2 must tolerate the thermic limit value of the current of the protecting secondary winding 5.

The measuring information and the protecting information are independent in the sense that if, for some reason or other, the measuring load or the protecting load remains open, the feeding of the other information is nevertheless not interrupted. By dimensioning the capacitance of the capacitor $Z_C$, $$C \simeq 1/\omega^2 L_o,$$

wherein $L_o =$ the nonload inductance measured across the protecting winding, the errors can be made approximately independent of the load. When the nonload inductance is measured, the primary winding 9 is open and the measuring winding 2 is short-circuited.

In practice, this capacitor $Z_C$ is placed at the base (not shown) of the current transformer or at the terminals 1S1' and 1S2' of the protecting winding (FIG. 3).

It should be mentioned that the core parts 1, 6, and 3 as well as 8, 10 are mainly intended to be manufactured by laying sheets radially. The protecting core 3 may also be manufactured appropriately by winding out of foil tape, with insulating tape in between.

What I claim is:

1. A shell core current transformer comprising a tubular main insulator, a magnetic tubular measuring core having inner yokes and a magnetic tubular return core having outer yokes, said main insulator being arranged substantially coaxially between said measuring and return cores, a primary winding within said return core between said outer yokes, a secondary measuring winding within said measuring core between said inner yokes, a protecting core within said measuring core between said inner yokes and disposed coaxially with said main insulator, a protecting secondary winding within said measuring core between said inner yokes and between said protecting core and said main insulator, said secondary measuring winding being between said protecting core and said measuring core, said return core comprising a magnetic return circuit, whereby said primary winding serves both as a primary winding for said measuring core and as a primary winding for said protecting core.

2. A shell-core current transformer as claimed in claim 1, wherein the secondary windings are connected in series.

3. A shell-core current transformer as claimed in claim 1, wherein a measuring load is connected to the terminals of the secondary winding of the measuring core and a protecting load is connected to the extreme terminals of the series connection of both secondary windings.

4. A shell-core current transformer as claimed in claim 1, wherein the primary winding and the secondary windings have at least approximately equal axial dimensions.

5. A shell-core current transformer as claimed in claim 1, wherein the primary winding and the secondary windings are positioned axially at least approximately opposite each other.

6. A shell-core current transformer as claimed in claim 1, wherein the axial dimension of the protecting core is slightly inferior to the axial dimensions of the secondary windings of the measuring core and of the protecting core so that an air gap is formed at each end between the end of the inner part of the protecting core and the inner yokes of the measuring core.

7. A shell-core current transformer as claimed in claim 3, wherein a capacitor is connected to the terminals of the secondary winding of the protecting core, which capacitor is, within the operating frequency, tuned in resonance with the nonload inductance measured across the protecting secondary winding.

* * * * *